US005655390A

United States Patent [19]

Jansson et al.

[11] Patent Number: 5,655,390

[45] Date of Patent: Aug. 12, 1997

[54] SUSPENSION-TREATING DEVICE

[75] Inventors: Ulf Jansson; Rolf Ekholm, both of Karlstad, Sweden

[73] Assignee: Kvaerner Pulping Technologies Aktiebolag, Sweden

[21] Appl. No.: 545,482

[22] Filed: Oct. 19, 1995

Related U.S. Application Data

[63] Continuation-in-part of Ser. No. 262,507, Jun. 20, 1994, Pat. No. 5,461,888.

[30] Foreign Application Priority Data

Apr. 21, 1994 [SE] Sweden ..... 9401345

[51] Int. Cl.[6] ..... D06B 5/26

[52] U.S. Cl. ..... 68/181 R; 68/184; 210/781; 210/366; 162/251

[58] Field of Search ..... 68/181 R, 184, 68/182; 8/156; 162/251; 210/781, 780, 365, 367, 377

[56] References Cited

U.S. PATENT DOCUMENTS

| | | | |
|---|---|---|---|
| 1,496,517 | 6/1924 | Boehm | 68/181 R |
| 2,680,684 | 6/1954 | Obenshain | 162/251 |
| 3,454,163 | 7/1969 | Read | 210/781 |
| 3,524,551 | 8/1970 | Richter | 68/181 R |
| 3,943,034 | 3/1976 | Wallen . | |
| 3,984,317 | 10/1976 | Donovan | 210/781 |
| 4,215,447 | 8/1980 | Gartland et al. | 68/181 R |
| 4,283,938 | 8/1981 | Epper et al. | 210/367 |
| 4,646,979 | 3/1987 | Musselmann et al. | 68/181 R |
| 5,227,057 | 7/1993 | Lundquist | 210/377 |
| 5,296,152 | 3/1994 | Frykhult . | |

*Primary Examiner*—Frankie L. Stinson
*Attorney, Agent, or Firm*—Ronald P. Kananen

[57] ABSTRACT

A device for treating a preferably cellulose containing suspension, comprising a housing (110) on a stand (112), characterized in that it comprises an injection chamber (132) limited by two disc-shaped wall members (134) arranged so as to rotate about a center of rotation (C') common to the axle, in that at least one inlet opening (130) is disposed in the inner part of the chamber (132) for the suspension to be treated, in that outlets (167) for the treated suspension are disposed in an outer part (166) (the acceptance space) of the injection chamber (132), in that extraction chambers (170) are disposed outside the wall members (134) of the injection chamber (132), in that openings (164) for filtrate are disposed between the injection chamber (132) and the extraction chamber (170) within at least one annular zone of the radial extent of the wall members (134), in that outlets (130) for filtrate are arranged from the extraction chambers, and in that the size of the injection chamber is variable.

14 Claims, 11 Drawing Sheets

SUSPENSION-TREATING DEVICE

BACKGROUND OF THE INVENTION

This is a continuation-in-part application of applicants' U.S. application Ser. No. 08/262,507, filed Jun. 20, 1994 now U.S. Pat. No. 5,461,888.

FIELD OF THE INVENTION

The present invention relates to a device for treating a suspension, preferably containing cellulose. The invention also relates to a wall member that can be incorporated into the treating device.

DESCRIPTION OF THE PRIOR ART

In many parts of processes for the production of cellulose pulp or similar, the cellulose-containing suspensions are thickened or washed in order, for example, to increase the concentration somewhere in the process or in order to purify the suspension. Generally, drum filters are then used in the thickening operation. Conventionally, a drum filter comprises a water-permeable drum on which the suspension is led up to allow water to drain off and normally produces an increase in concentration from 2–3% to 20%.

During a washing operation, pure water is added in or after the drum filter. These drum filters are, however, very large and space-consuming. In the majority of modern processes, attempts are made to reduce the size of the installation in order to save costs, which is made more difficult by the conventional large drum filters. Another drawback with the drum filters is that they are difficult to control with regard to process requirements and process parameters.

SUMMARY OF THE INVENTION

The object of the present invention is to provide a device for the thickening and/or washing of a suspension, which device is compact in its construction and can be controlled on the basis of process requirements and process parameters.

This object is achieved by a device comprising a housing mounted on a stand, characterized in that the device comprises an injection chamber limited by two disc-shaped wall members arranged so as to rotate about a center of rotation common to the axle, in that at least one inlet opening is disposed in the inner part of the chamber for the suspension to be treated, in that outlets for the treated suspension are disposed in an outer part (the acceptance space) of the injection chamber, in that extraction chambers are disposed outside the wall members of the injection chamber, in that openings for filtrate are disposed between the injection chamber and the extraction chamber within at least one annular zone of the radial extent of the wall members, in that outlets for filtrate are arranged from the extraction chambers, and in that the size of the injection chamber is variable.

In one embodiment, the device is provided with liquid distributors in the injection chamber, having liquid outlets or mouthpieces directed towards the outer part of the injection chamber. Additional characteristics, aspects, advantages and objectives of the invention derive from the patent claims and from the following description of two embodiments.

BRIEF DESCRIPTION OF THE DRAWINGS

The device according to the invention will be described in detail below in connection with the preferred embodiments and with reference to the appended drawings, in which.

DETAILED DESCRIPTION OF PREFERRED EMBODIMENTS

Figure 1:
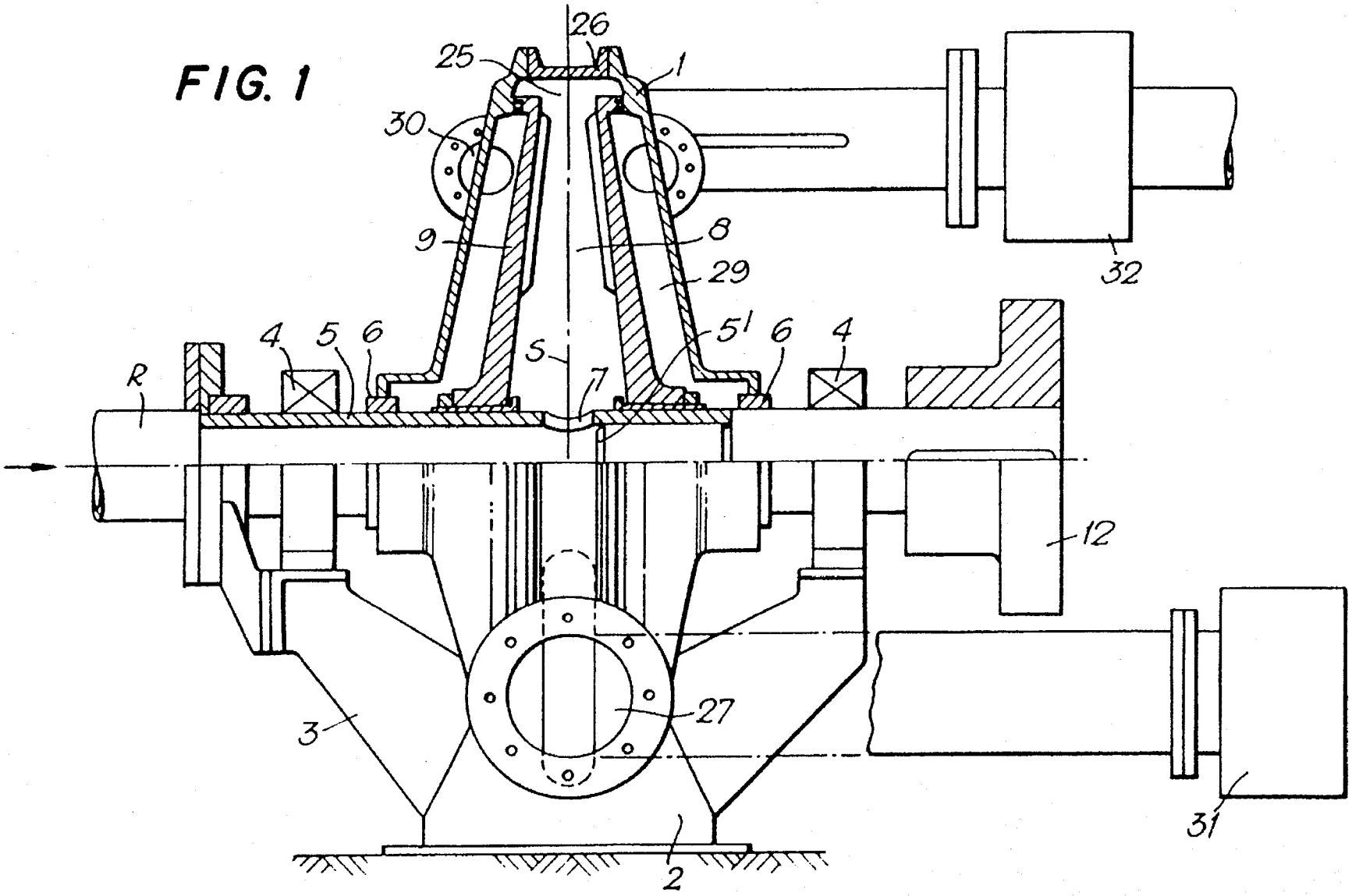
FIG. 1 shows a side view, partially in section, of a first embodiment of the device according to the invention.
Figure 2:
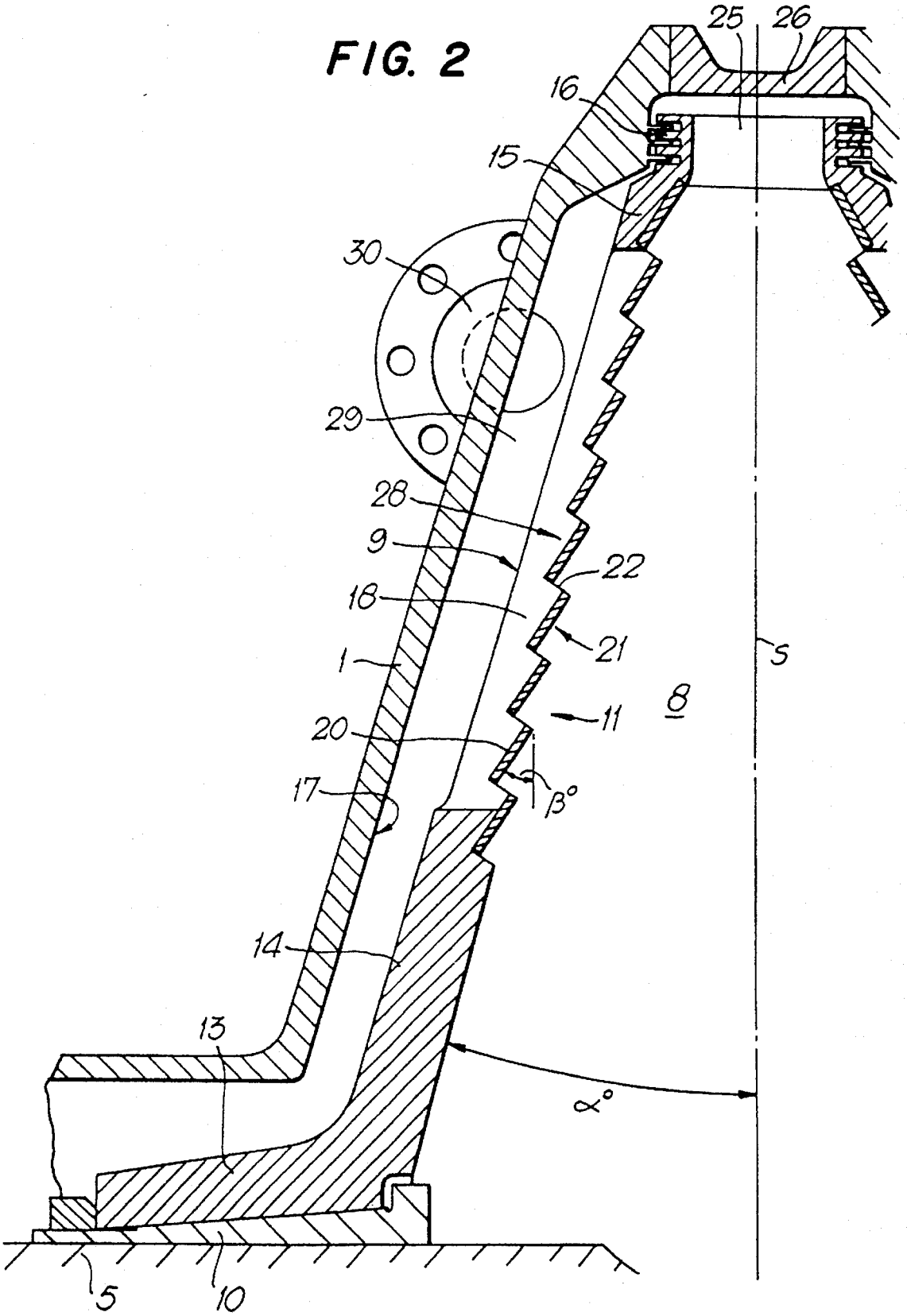
FIG. 2 shows the extraction unit of the first embodiment of the device, partly in section.

A device according to a first embodiment of the invention for treating a cellulose containing suspension, as shown in FIGS. 1 and 2, comprises a housing 1 which is connected to a stand 2. This stand 2 is provided with arms 3, each arm having upwardly directed surfaces on which a bearing housing exhibiting bearings 4 is mounted. A hollow axle 5 is mounted rotatably in these bearings 4 and runs through the housing 1. The axle 5 forms a pipeline up to a stop wall 5' somewhat to the right of a plane of symmetry S belonging to the housing 1. Seals 6 are arranged in a manner known per se between the housing 1 and the axle 5. The hollow end of the axle 5 is suitably connected to a pipe system R, which distributes the suspension. The other end is connected to a suitable drive device (not shown), which can preferably be regulated in its rotational speed via transmission members 12.

The hollow axle 5 is provided with a number of radial openings 7 directly before the stop wall 5'. These openings 7 are linked to a space 8, referred to as the injection chamber, which is formed by two opposing rotary wall members 9 mounted suitably on the rotary axle, preferably by an axially adjustable wedge joint 10 in the form of a sleeve. The wall members 9 have the shape of two circular discs on either sides of the plane of symmetry S, which is perpendicular to the axle 5.

The axle 5 runs through the center of the wall members 9. In the preferred embodiment, the disc-shaped wall members 9 have straight inner walls, and the distance between the mutually facing walls 11 decreases from the axle and out toward the periphery of the wall members 9, i.e., they incline towards each other, each at an angle $\alpha$ (FIG. 2) to the plane of symmetry S and to the normal of the axle. The injection chamber 8 therefore acquires a shape which in cross-section, viewed radially outward from the axle 5, narrows into a wedge-shape.

The inner walls 11 of the wall members 9 can also have a different configuration than straight. They can be convexly or concavely configured, but in this case have a mean angle of inclination α.

Figure 3:
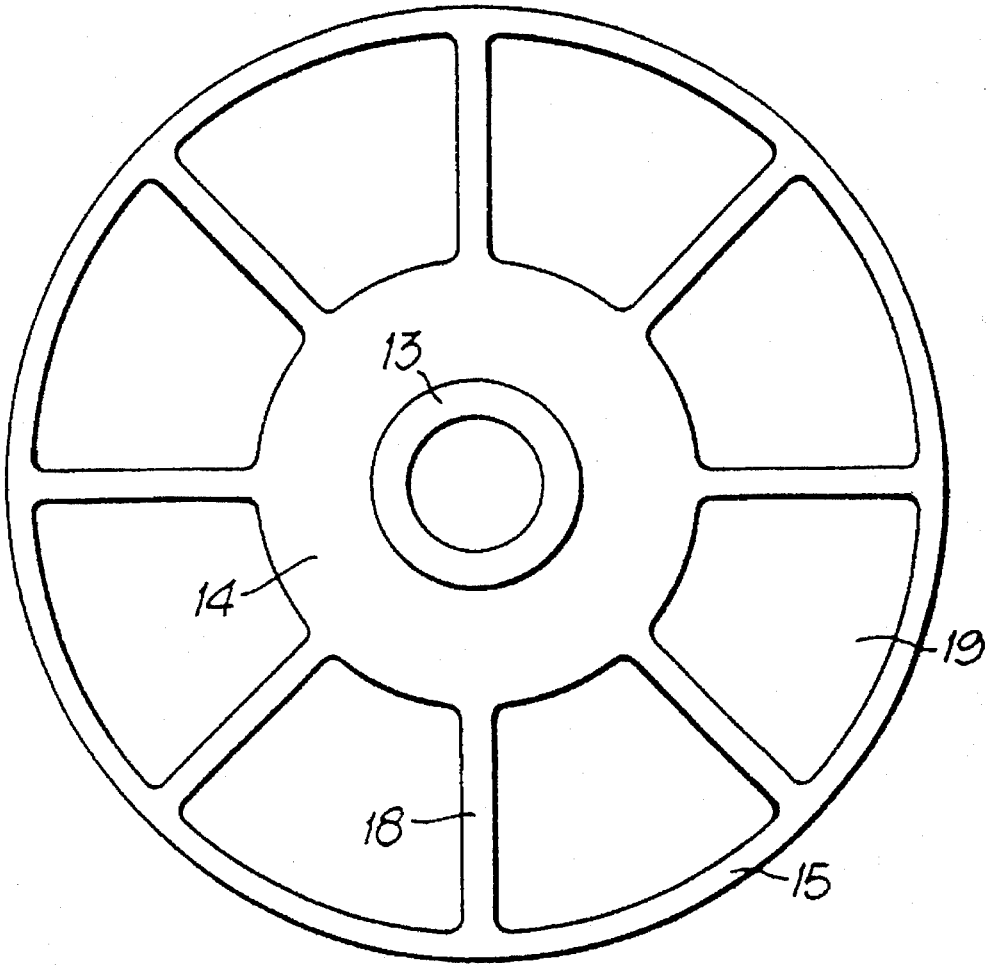
FIG. 3 shows a side view of the wall member without separating members.

The wall members 9 are put together in the following way, as shown in FIGS. 2 and 3. They are provided at the center with a flange 13 interacting with the sleeve-shaped wedge 10, which is axially adjustable. The flange 13 then merges into a disc-shaped segment 14. The periphery of the rotary wall member 9 is constituted by an annular part 15 provided with sealing devices 16, for example labyrinth seals, for sealing against a segment of the outer part of the inner side wall 17 of the stationary housing 1. The disc-shaped segment 14 and the annular part 15 are joined together by a number of supporting members or spokes 18. In this way, apertures 19 are formed within an annular zone of the radial extent of the wall member. These apertures 19 are arranged with separating members 20. According to the preferred embodiment, the separating members comprise annular lamellae placed concentrically in the radial direction one after the other, viewed towards the periphery of the wall members 9, and fastened suitably on the supporting members 18 and angled so that their inner surfaces 21 have an angle β, which is larger than α, to the normal of the axle. In this way, slot-shaped openings 22 are formed between the lamellae 20, which run right around the wall member 9. The lamellae 20 are made, for example, from stainless band-steel, which is shaped into rings. Other embodiments of the separating members 20 are also possible. It is therefore conceivable to use the wall members according to SE-B-446 706, which, by reference, are incorporated into this patent application, but in this case having the direction of flow in transverse direction to that which is there described and having the separating profiles designed as rings instead of as rods.

In the peripheral part of the injection chamber 8 there is a space 25, referred to as the acceptance space, which is limited by the annular, peripheral part 15 of the wall members and by a cylindrical outer wall 26 belonging to the housing 1, which outer wall 26 connects the two side walls 17. This space 25 is connected to an essentially tangentially disposed outlet 27 for the removal of the treated suspension. The outlet has preferably the same diameter as the greatest width in respect of the acceptance space 25.

Between the outer sides 28 of each of the two wall members 9 and the housing 1 there is a space 29, referred to as an extraction chamber, for the reception of the extracted medium. Each chamber 29 has an essentially tangentially disposed outlet 30. According to the embodiment, the inner side walls 17 of the housing 1 have the same inclination relative to the plane of symmetry S as the wall members 9, so that the extraction chamber 29, in cross-section, acquires a slot-shaped appearance.

By virtue of the fact that the wall members 9 are provided with sealing members 16 along their circumference, which sealing members 16 seal against the housing 1, the injection chamber 8 is able to communicate with the extraction chambers 29 only through openings 22 between the lamellae 20. The two extraction chambers 29 do not communicate with each other in the housing, but they are preferably connected, after the respective outlet 30, to a common pipe system in which any pressure variations between the two chambers are equalized.

The functional operation is as follows. The axle 5 is rotated by a motor (not shown) via the transmission members 12. The axle 5 rotates, in turn, the two wall members 9 in the stationary housing 1. The suspension to be treated is introduced into the hollow axle 5, at suitable predetermined pressure, up to the stop wall 5'. The suspension then proceeds to pass out through the radial openings 7 in the axle and into the injection chamber 8. Thanks to the inlet pressure and the rotation of the wall members 9 of the injection chamber 8, the suspension proceeds to move radially outward. By virtue of the fact that the injection space 8 narrows down in a wedge shape, the suspension is subjected to a lateral pressure as it moves outward. In this way, the liquid in the suspension proceeds to be pressed out through the slot-shaped openings 22 in the separating member 20 and collected in the extraction chambers 29, so as then to be led out through the outlets 30. The suspension which has been thickened finally ends up in the acceptance space 25 in the outer part of the injection chamber 8 and is removed through the outlet 27, which is preferably connected to a suitable regulating device 31 such as, for example, a speed-controlled screw pump.

The outlets 30 are provided with regulating members 32 for controlling the counter-pressure in the extraction chambers 29. The device according to the invention has a plurality of control and regulating facilities for achieving the desired process requirements. The inlet pressure of the suspension can thus be varied, as can the rotation speed of the axle 5 and the wall members 9 and hence the centrifugal force and consequently the pressure of the suspension against the walls of the injection chamber 8. In addition, the outlets for the separated-off liquid (rejects) and for the treated suspension are provided with regulating devices in the form of check valves, for example. In this way, the quantity of liquid in the treated suspension can be controlled by the combination of inlet pressure/pressure against the wall members and the counter-pressure in the extraction chamber. Thanks to the facility for balancing the inlets and outlets, a hydraulic system is obtained which can be controlled very well in dependence upon the process requirements. This embodiment is intended as a thickener of the suspension.

Figure 4:
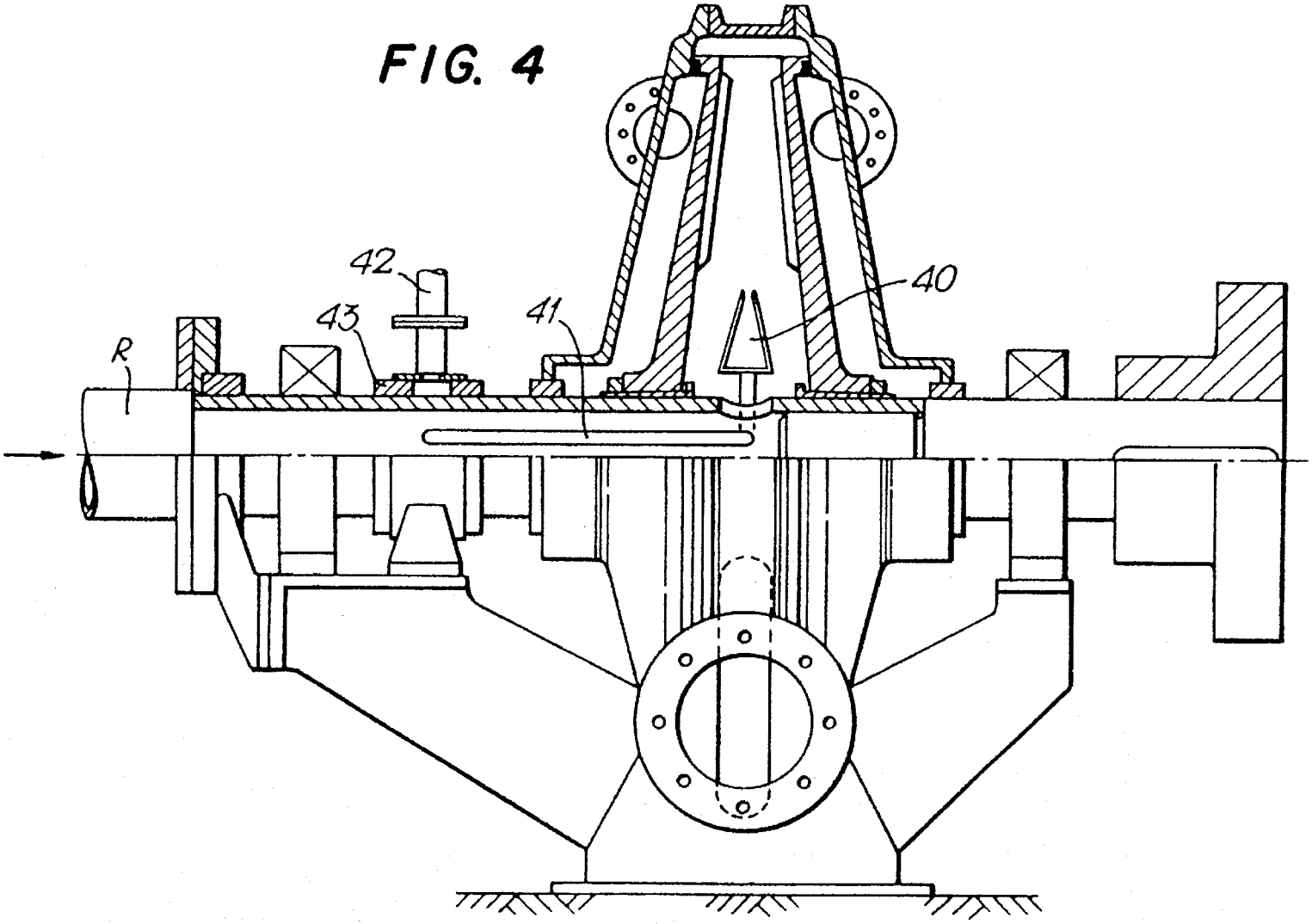
FIG. 4 shows the same view as FIG. 1, but for a second embodiment.
Figure 5:
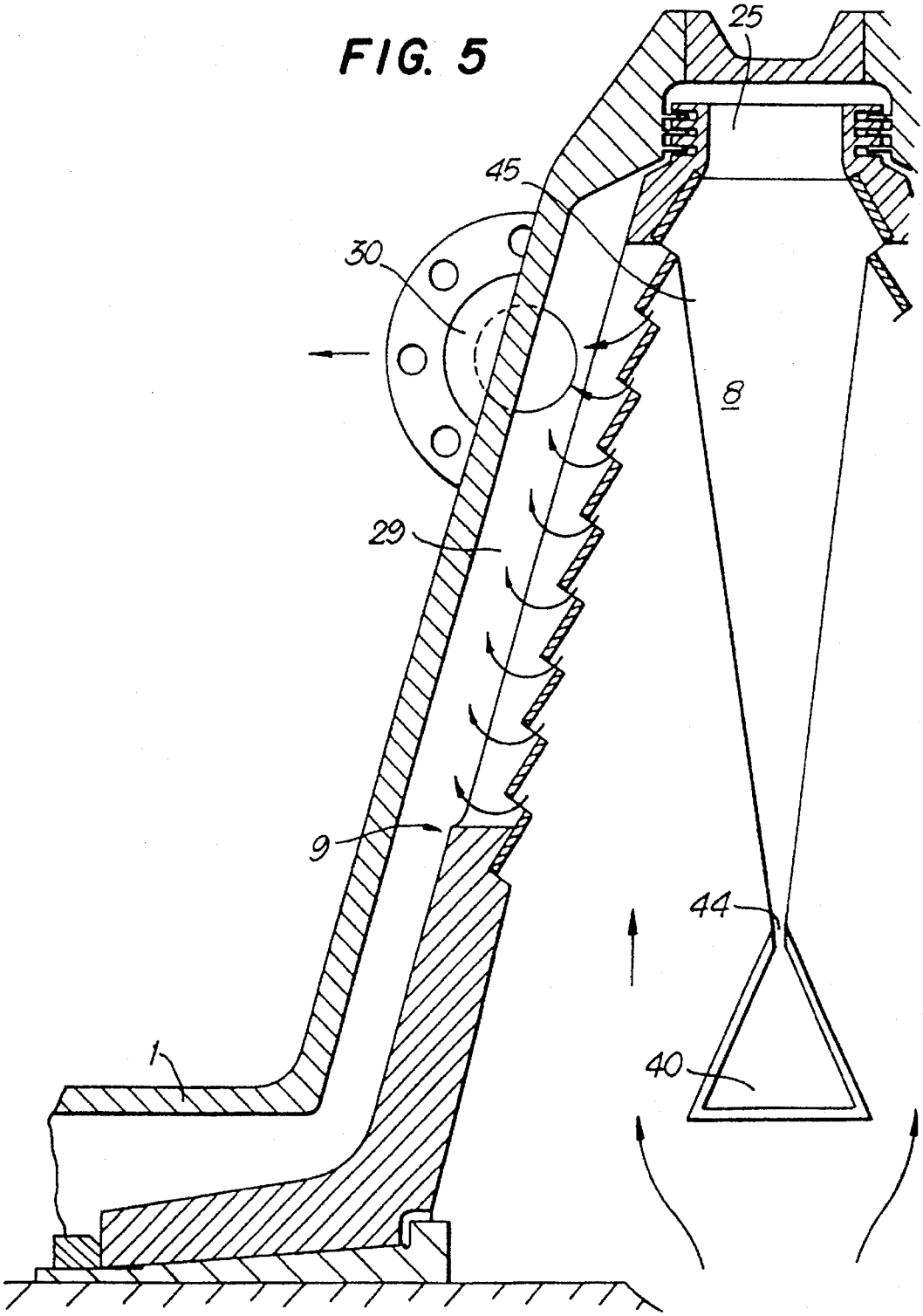
FIG. 5 shows the same view as FIG. 2, but for the second embodiment.

A second embodiment is shown in FIGS. 4 and 5. In the second embodiment, the device is provided with a number of liquid distributors 40 placed in the lower part of the injection chamber 8, symmetrically between the wall members 9. Connected to these are pipes 41, which are drawn through the wall of the hollow pipe 5 and some distance along the inner wall of the axle, so as to then be linked via conduits to a liquid connection 42 for washing liquid, via a packing box 43 which seals around the axle in a known manner. Preferably, the pipe conduits between the axle 5 and the injection chamber 8 are placed between the openings 7 for the suspension. The liquid distributors 40 are configured having outlet openings or mouthpieces 44 directed towards the outer part 25 of the injection chamber 8 (the acceptance space), which mouthpieces 44 are configured such that a liquid jet 45 having a relatively small discharge angle is formed.

The second embodiment is intended for use in the washing of the suspension. In this embodiment, when the suspension enters the injection chamber 8, it is subjected, as described above, to centrifugal forces and is pressed against the walls of the wall members 9, so that the liquid in the suspension is pressed out through the slot-shaped openings 22. At the same time, new liquid is supplied from the liquid distributors 40, which further helps to expel the old liquid.

By virtue of the inclination of the wall members 9, there is thus obtained in the acceptance space 25 a suspension which can contain just as much liquid as previously, but which is mainly fresh.

It is also possible to conceive of the suspension in the acceptance space 25 containing less liquid than the untreated suspension, i.e, of the treatment comprising both washing and dehydration, as well as of it containing more liquid than the original suspension, i.e., of the treatment comprising washing and dilution. It should therefore be understood that the second embodiment having a liquid distributor can also be used as a thickener, i.e., without supplying any fresh liquid.

Figure 6:
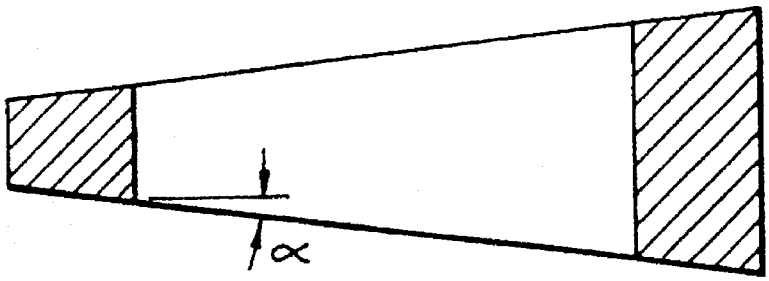
FIG. 6 illustrates the calculation of the inclination of the wall members.

Since there is no desire, on the one hand, for the pulp suspension to be pulled apart, the angle α for the wall members 9 is important to the functioning of the device so as to ensure that a constant pressure should be obtained against the wall members 9 from the axle and out to the periphery, and especially along the separating members 20, and that the separating members 20 are not blocked up again by fibers. If a wash-water factor =1.0 is assumed, i.e., if it is assumed that, following washing treatment of the suspension according to the second embodiment, there is an equal amount of liquid remaining, but exchanged for clean liquid, i.e., the outlet area (the area between the wall members 9) in the periphery is half the area at the inlet, and the clearance at the hub is 200 mm, then there is obtained, according to FIG. 6:

$$(500\times p\times 200)/2=1400\times p\times B,\ B=36 \text{ mm tang. } \alpha=82/450,\ \alpha=10.3°.$$

If it is assumed that the pulp is homogenous and takes up a disc surface area of 1 $dm^2$ (FIG. 6) and the distance between the discs at the axle is 200 mm, a height of 1.82 dm is obtained. The rotational speed is set at 1000 r.p.m. A centrifugal force at the hub is then obtained according to:

$$F_{hub1000}=1.82\ (p\times 0.6\ (1000/60)^2/0.3=5988\ N.$$

The centrifugal force at the periphery:

$$\text{pulp height}=36+2\times 9=54 \text{ mm},$$

$$F_{per1000}=0.54\ (p\times 1.3\ (1000/60)^2/0.65=3849\ N,$$

Thus, the centrifugal force is greater at the hub than at the periphery, which means that the bed is prevented from being pulled apart. Thanks to the inclination α, a constant pressure is obtained along the wall members out toward the periphery, which also, together with the configuration of the separating members, prevents the latter from becoming blocked, whilst the separating members simultaneously prevent the cellulose-containing part of the suspension from being expelled through the separating members.

Figure 7:
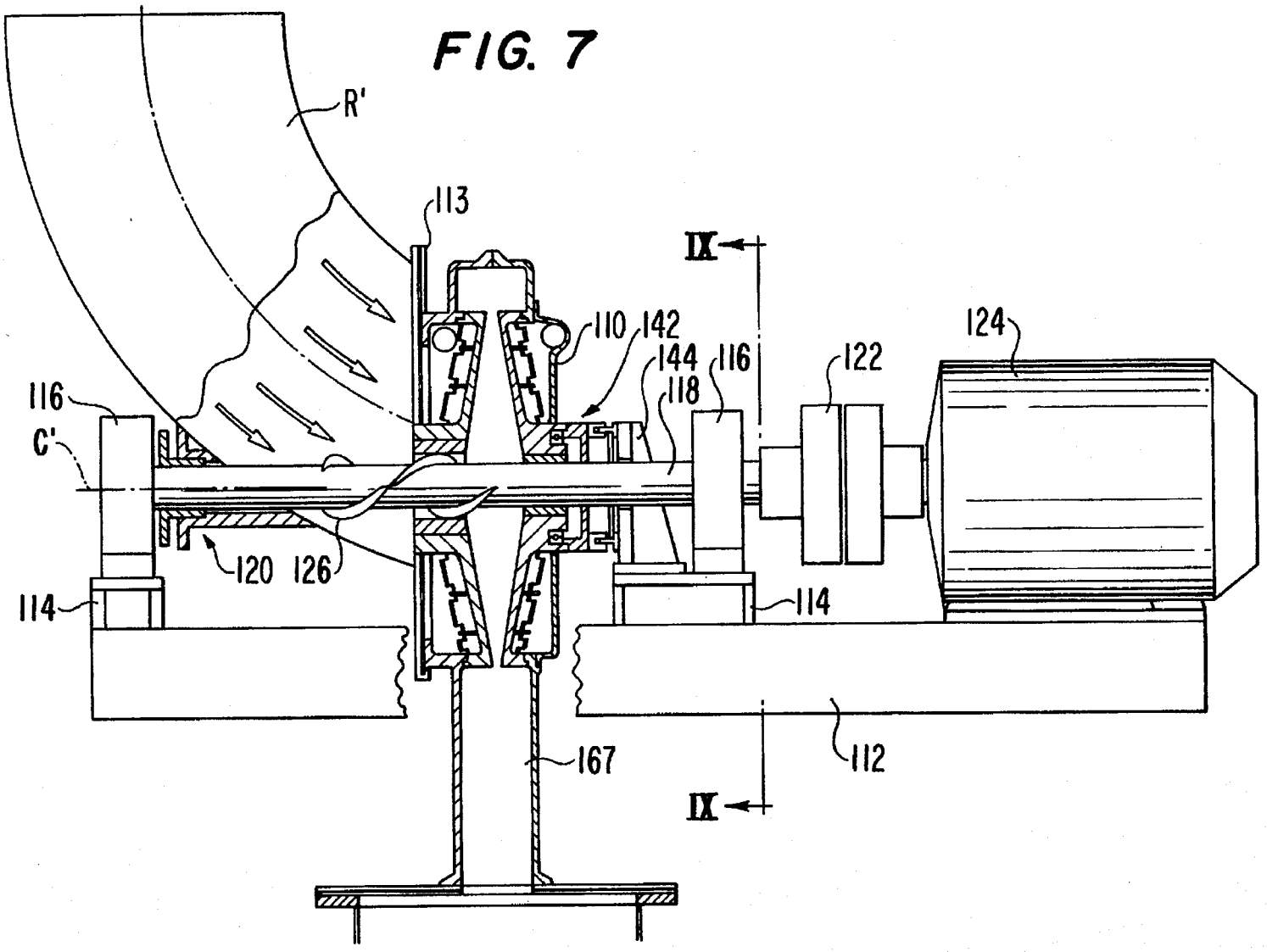
FIG. 7 shows a dissected side view of a third embodiment of a device according to the invention.
Figure 8:
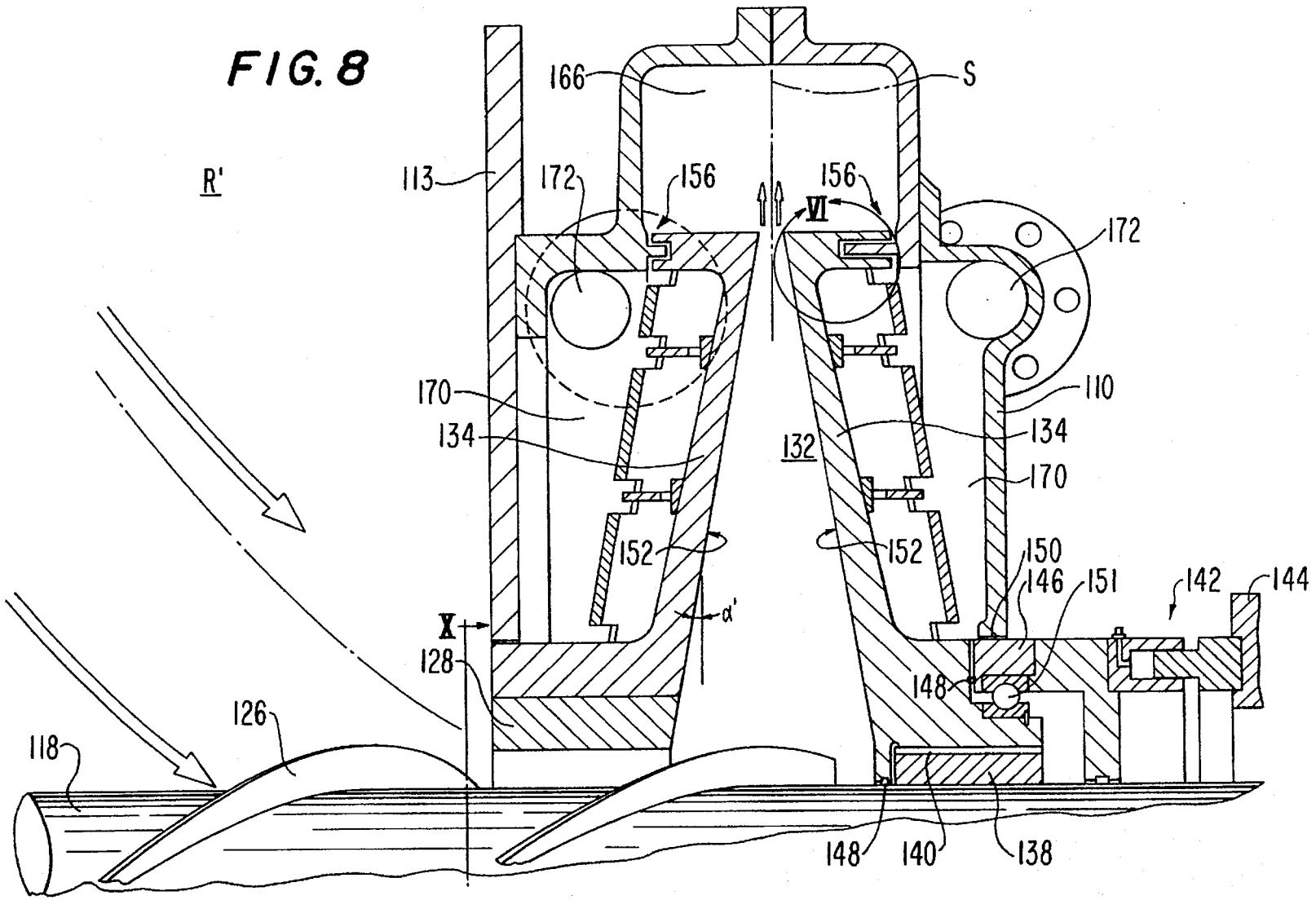
FIG. 8 shows a dissected part-view of the extraction assembly of the third embodiment.

A third embodiment will now be described with reference to FIGS. 7 to 12. A device according to the third embodiment of the invention for treating a cellulose-containing suspension, as shown in FIGS. 7 and 8, comprises a housing 110 which is connected to a stand 112. A pipeline R' for the supply suspension to be treated is fitted to one side of the housing 110. An end plate 113 is disposed between the pipeline R' and the housing 110. The pipeline R', in the third embodiment, is designed as a 90° bend, originating from above, before the connection to the housing 110, i.e., a pipe chute which is commonly found in pulp processes.

The stand 112 is provided with supporting elements 114, each having upwardly directed surfaces on which bearing housings with bearings 116 are mounted. An axle 118 having a rotation axis C' is rotatably mounted in these bearings 116 and runs through the housing 110 and the lower part of the pipe chute R'. A seal 120 is disposed in a known manner around the entry of the axle 118 into the pipe chute R'. The other end of the axle 118 is connected by an axle coupling 122 to a suitable drive device 124, for example an electric motor, which is preferably capable of being speed-regulated.

The axle 118 is provided with a number of helical blades 126, here referred to as fluidizer blades, which extend from inside the pipe chute R' into the housing 110. A cylindrical spacing sleeve 128 (FIGS. 8 and 9) is fitted to the fluidizer blades 126 such that cavities 130 are formed between the spacing sleeve 128 and the fluidizer blades 126. The spacing sleeve 128 is thus fitted to the blades such that the one end is in line with that side of the end plate 113 which faces the pipe R'. The cavities 130 communicate with a space 132, referred to as the injection chamber, in the housing 110. The injection chamber 132 is formed by two opposing wall members 134, which have the shape of two circular discs, the center of which coincides with the center of rotation C', on both sides of a plane of symmetry S', which is perpendicular to the axle 118. The one wall member is fixedly mounted on the spacing sleeve 128 by means of, for example, a key joint 136 and suitably forms a seal against the end plate 113.

The other wall member 134 is disposed such that it is fixedly rotatable but axially displaceable on the axle 118. The fixed rotatability and axial displacement are made possible, on the one hand, by a sleeve 138 fixed to the axle 118, which is provided with splines 140 or similar structure, and a corresponding boring with splines in the wall member and, on the other hand, by a hydraulic cylinder 142 designed as a ring, which can be, for example, an SKF hydraulic ring unit. This unit 142 operates between a support 144 fitted to the supporting element 114 and a spacing ring 146 which is sealed, on the one hand, against the housing 110 and, on the other hand, against the wall member by means of seals 148, 150. Between the spacing ring 146 and the wall member 134 there is disposed a bearing 151.

The disc-shaped wall members 134 have, in the third embodiment, straight inner walls, and the distance between the opposite-facing walls 152 diminishes from the axle 118 and out toward the periphery of the wall members 134, i.e., they slant towards each other, each at an angle α' (FIG. 8), towards the plane of symmetry S' and towards the normal of the axle. The injection chamber 132 thus acquires, in cross-section, a shape which is tapered in a wedge shape, viewed radially outward from the axle 118.

The inner walls 152 of the wall members 134 can also be designed other than straight. They can be of convex or concave design, but in this case have a mean angle of inclination α'.

The periphery of the wall members 134 is constituted by an annular part 154 (FIG. 11) provided with sealing devices 156 (FIG. 8), for example labyrinth seals, for sealing against a portion of the inner wall of the stationary housing 110. The axially displaceable wall member 134 has a deeper labyrinth seal, so that this seals for all positions of the wall member 134.

Figure 11:
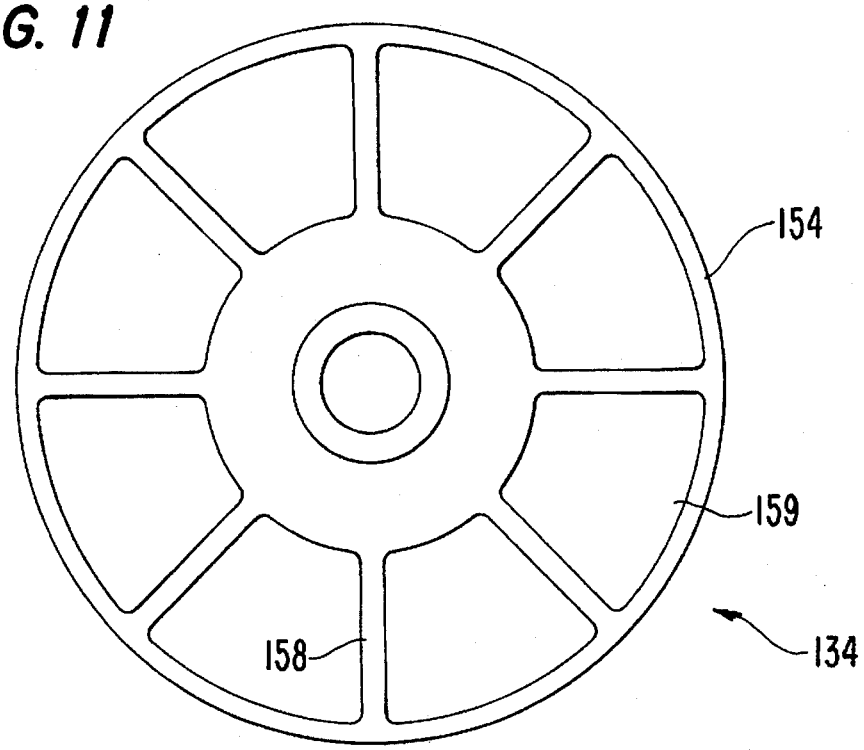
FIG. 11 shows a side view of a wall member without separating members.
Figure 12:
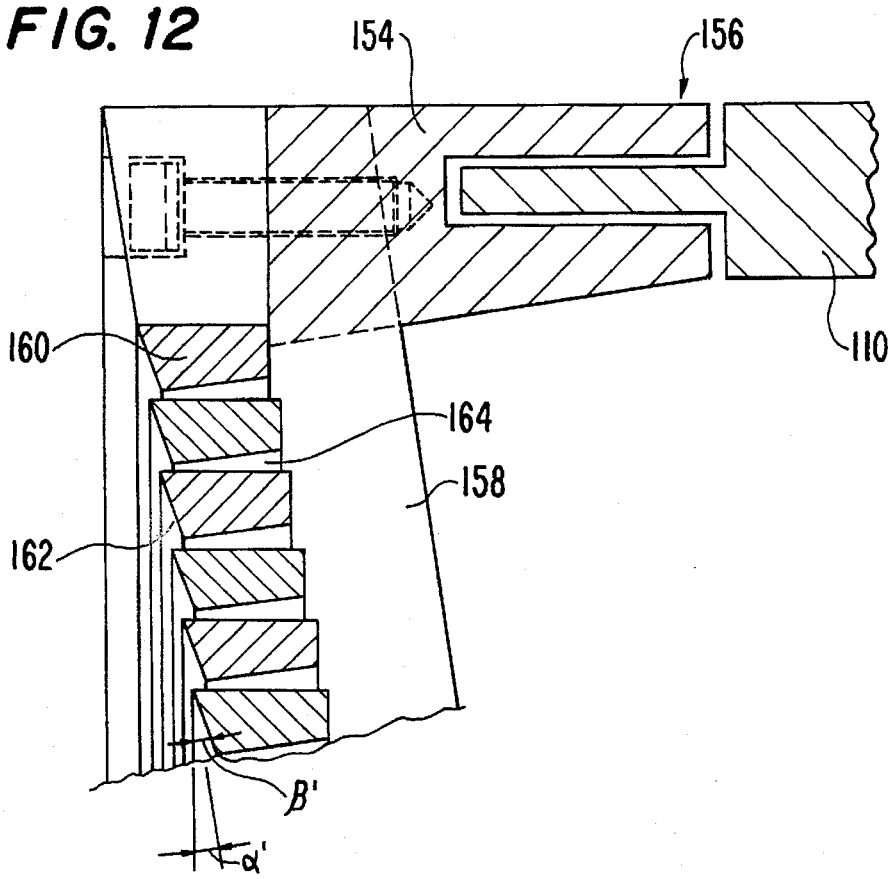
FIG. 12 shows a part-view in section of the wall member and the separating members.

That portion of the wall member 134 which abuts against the axle 118 and the annular part 154 are joined together by a number of supporting members or spokes 158 (FIG. 11). In this way, apertures 159 are formed within an annular zone of the radial extent of the wall member. These apertures 159 are arranged with separating members 160. According to the third embodiment as shown in FIG. 12, the separating members comprise annular profiles, which are placed concentrically one after the other in the radial direction, viewed towards the periphery of the wall members 134, and are suitably fastened to the supporting members 158. They are designed such that their inner surfaces 162 have an angle β', which is greater than α', to the normal of the axle. As a result of the design and positioning, gap-shaped openings 164 are formed between the profiles 160, which run right around the wall member 134. Other embodiments of the separating members 160 are also possible.

In the peripheral part of the injection chamber 132, a space 166, referred to as the "acceptance space", is disposed in the housing 110 radially outside the annular peripheral part 154 of the wall members. According to FIG. 9, the acceptance space is not concentric, but increases from right to left, i.e., in the direction of rotation. At the bottom of the housing there is disposed an outlet 167 for the treated suspension. This connects, in the third embodiment, to a pipe system (not shown) for further treatment of suspension. Alternatively, the outlet 167 can connect to a pipe chute which is fitted to an additional device according to the invention, a washing apparatus or an MC-pump.

Figure 9:
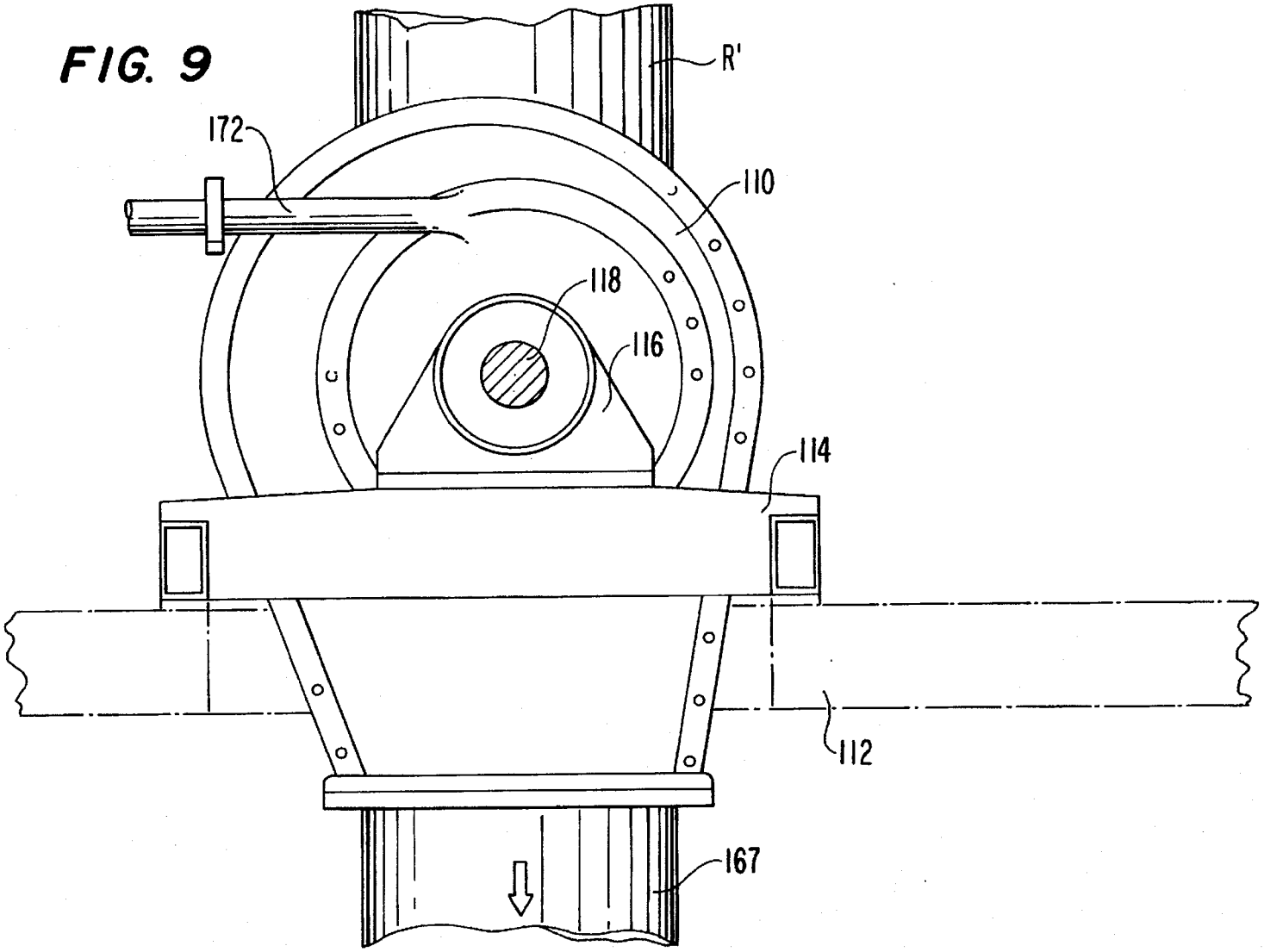
FIG. 9 shows a side view of the device in FIG. 7, taken along the line IX—IX in FIG. 7.
Figure 10:
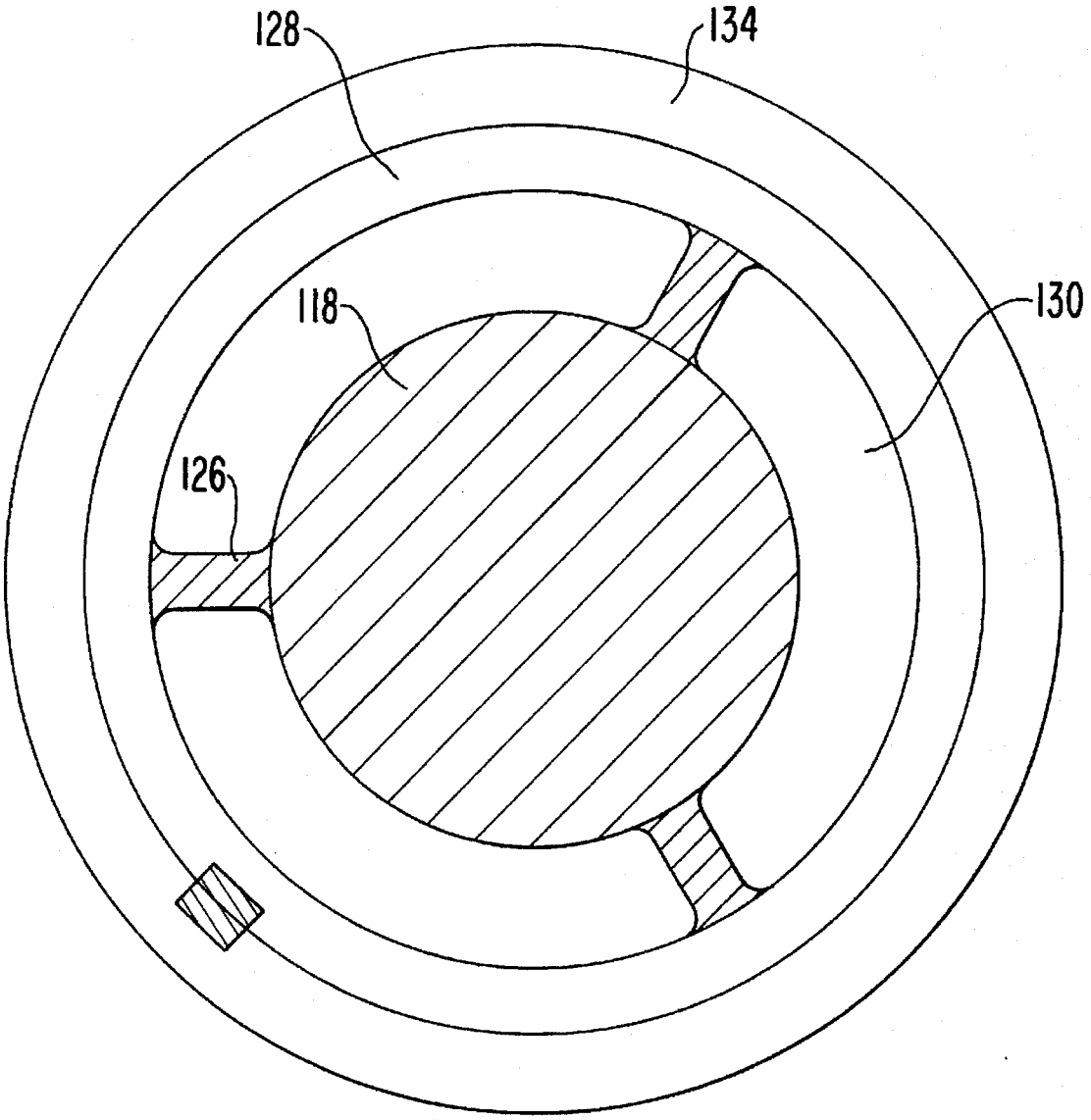
FIG. 10 shows a part-view in section taken along the line X—X in FIG. 8.

Between the outer sides 168 of each of the two wall members 134 and the housing 110 there is a space 170, referred to as the extraction chamber, for the reception of the extracted medium. Each chamber 170 has an essentially tangentially disposed outlet 172, as seen in FIG. 9.

By virtue of the fact that the wall members 134 are provided with sealing members 156 along their circumference, which sealing members 156 seal against the housing 110, the injection chamber 132 is able to communicate with the extraction chambers 170 only through the openings 164 between the laminae 160. The two extraction chambers 170 do not communicate with each other in the housing, but they are preferably connected, after the respective outlet 172, to a common pipe system in which any pressure variations between the two chambers are equalized.

Working operation is as follows. The axle 118 is rotated by the motor 124. The axle 118, in turn, rotates the two wall members 134 in the stationary housing 110 about the common rotation axis C', the left-hand one (as viewed in FIG. 8) via the fluidizer blades 126 and sleeve 128 and the right-hand one via splines 140. The suspension to be treated is conducted from the pipe chute R' into the cavities between the vanes and the sleeve, the suspension being simultaneously fluidized by the vanes, and into the injection chamber 132. Owing to the inlet pressure and the rotation of the wall members 134 of the injection chamber 132, the suspension ends up moving radially outward. As a result of the wedge-shaped narrowing of the injection space 132, the suspension is subjected to a lateral pressure as it moves outward and, out toward the periphery, becomes clogged, the result of which is that the material behind becomes compressed against the clogged material and against the lateral surfaces 152 of the wall members. In this way, the liquid in the suspension ends up being forced out through the gap-shaped openings 164 in the separating member 160 and is collected in the extraction chambers 170, so as then to be conducted out through the outlets 172. The suspension which has been thickened finally arrives in the acceptance space 166 outside the outer part of the injection chamber 132 and is taken out through the outlet 167, which is preferably connected to a suitable control device (not shown), such as, for example, a speed-controlled screw pump.

The device is regulated, in the first place, by displacing the axially movable wall member by means of the annular hydraulic unit. The motion is controlled by the differential pressure between the pressure of the incoming suspension in the pipeline R' and the pressure in the acceptance space. The outlets 172 are provided with control members (not shown) for controlling the counter-pressure in the extraction chambers 170. Alternatively, the motion can be regulated by the chute pressure and the pressure in the extraction chambers. The device according to the invention has, moreover, additional control and regulating facilities for achieving the desired process requirements. The rotation speed of the axle 118 and the wall members 134 can thus be varied and hence the centrifugal force and therefore the pressurization of the suspension against the walls of the injection chamber 132. The quantity of liquid in the treated suspension is thereby able to be controlled by the combination of inlet pressure/pressure against the wall members and the counter-pressure in the extraction chamber. As to the facility to balance the inlets and outlets, a hydraulic system is obtained which can be very well controlled, depending upon the process requirements. This third embodiment is envisaged as a thickener of the suspension.

Figure 13:
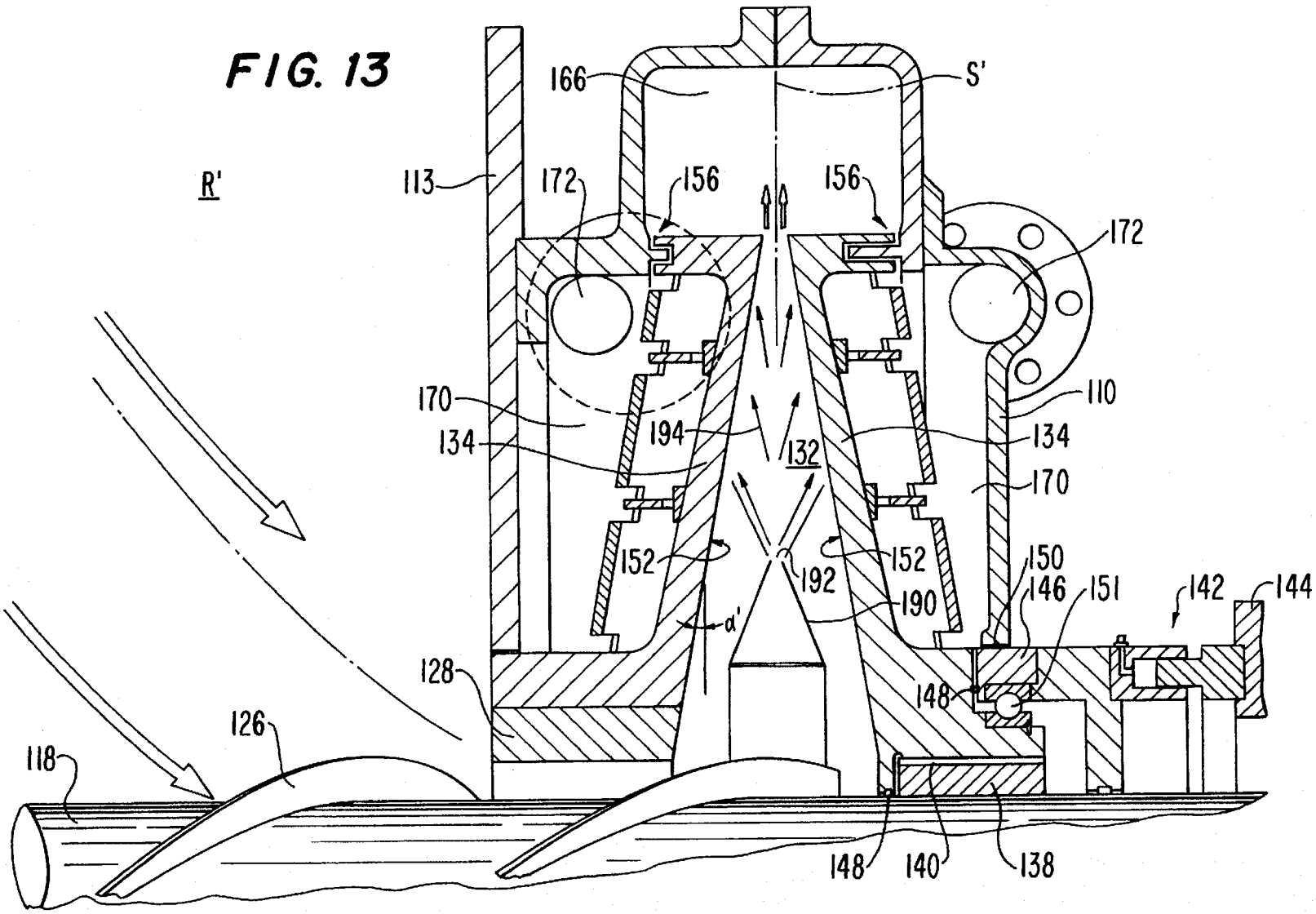
FIG. 13 shows the same view as FIG. 8, but for a fourth embodiment.

A fourth embodiment of the device is envisaged for use in washing the suspension. In this embodiment, the device is provided, in the lower part of the injection chamber 132, with an annular liquid distributor, the surface of which, which is directed towards the periphery of the injection chamber, is provided with an outlet slot running around its circumference, or a number of outlet openings, so that a liquid film is obtained. The device, as shown in FIG. 13, can also be provided with a number of liquid distributors 190 placed in the lower part of the injection chamber 132 symmetrically between the wall members 134. Connected to the liquid distributor(s) are passages (not shown), for example drawn through the axle 118 so as then to be connected, via ducts, to a liquid connection for washing liquid, which, in a known manner, is connected to and seals against the axle 118. The liquid distributors 190 according to FIG. 13 are designed having outlet openings or mouthpieces 192 directed towards the outer part of the injection chamber 132 and the acceptance space 166, which mouthpieces 192 are designed such that a liquid jet 194 having a relatively small outlet angle is formed.

When the suspension in the fourth embodiment enters into the injection chamber 132, it is subjected, as described above, to centrifugal forces and is forced against the walls of the wall members 134 so that the liquid in the suspension is forced out through the gap-shaped openings 164. At the same time, new liquid is supplied from the liquid distributors), which additionally helps to drive away the old liquid.

As a result of the inclination of the wall members 132, there is therefore obtained at the acceptance space 166 a suspension which can contain just as much liquid as previously, but which is mainly new.

It can also be envisaged that the suspension in the acceptance space 166 will contain less liquid than the untreated suspension, i.e., that the treatment comprises both washing and concentration, equally that it contains more liquid than the original suspension, i.e., that the treatment comprises washing and dilution. It should therefore be understood that the fourth embodiment with the liquid distributor can also be used as a thickener, i.e., without supplying any new liquid.

The angle α' for the wall members 134 is important to the working of the device, since, firstly, it is desirable that the pulp suspension should not be drawn apart, that a constant pressure should be obtained against the wall members 134 from the axle 118 and out to the periphery and specifically along the separating members 160, and that the separating members 160 should not be plugged by fibers.

A suitable choice of angle α' has the effect that the centrifugal force is greater at the hub than at the periphery, which means that the bed is prevented from being drawn apart. Owing to the inclination α', a constant pressure is obtained along the wall members out towards the periphery, which also, together with the design of the separating members, prevents these from becoming plugged, at the same time as the separating members prevent the cellulose-containing part of the suspension from forcing its way out through the separating members.

It follows from the above-stated that the invention should not be considered to be limited to the preferred embodiments described above and shown in the drawings, but can be subject to various modifications within the scope of the following patent claims.

We claim:

1. Device for treating a preferably cellulose-containing suspension, comprising:

a housing (110) on a stand (112);

an injection chamber (132) limited by two disc-shaped wall members (134) arranged so as to rotate about a center of rotation (C') common to an axle (118), at least one inlet opening (130) being disposed in the inner part of the chamber (132) for the suspension to be treated, and outlets (167) for the treated suspension being disposed in an outer part (166) of the injection chamber (132);

extraction chambers (170) disposed outside the wall members (134) of the injection chamber (132);

openings (164) for filtrate being disposed between the injection chamber (132) and the extraction chamber (170) within at least one annular zone of the radial extent of the wall members (134);

outlets (130) for filtrate being arranged from the extraction chambers; and a size of said injection chamber being variable.

2. Device according to claim 1, wherein the size of the injection chamber (132) is variable by means arranged for varying the mutual distance between the wall members (134).

3. Device according to claim 2, wherein the distance between said wall members (134) can be varied during operation.

4. Device according to claim 1, further comprising means for displacing at least one wall member (134) axially along said axle (118).

5. Device according to claim 4, wherein the axial motion of the wall member is performed by an annular hydraulic cylinder and is arranged to be regulated by the pressure differential between the inlet pressure of the suspension to be treated and the outlet pressure of the treated suspension.

6. Device according to claim 4, wherein said means for performing the axial motion of the wall member comprises an annular hydraulic cylinder and is regulated by the pressure differential between the inlet pressure of the suspension to be treated and the pressure in the extraction chambers.

7. Device according to claim 1, wherein the wall members are mounted having an inner part on said axle (118) on each side respectively of a normal plane (S') relative to the axle, the distance between the wall members (134) diminishes from the axle (118) and out toward a periphery of the wall members, and the wall members (134) slant toward each other and toward the normal plane.

8. Device according to claim 7, wherein said normal plane is a plane of symmetry (S') in the injection chamber (132), and the inner walls (152) of the wall members (134) are straight and slant towards each other at a respective angle (α') to said plane of symmetry (S').

9. Device according to any one of claim 1, wherein the inlet (130) for the suspension to be treated is disposed around the axle (118), the axle (118) is disposed having screw-shaped blades (126), referred to as fluidizer blades, at said inlet, which fluidizer blades extend from a pipe system (R') connected to said inlet (130) and into said injection chamber (132).

10. Device according to claim 9, wherein the pipe system (R'), which connects up to the inlet for the suspension (130) around the axis (S'), is a pipe chute.

11. Device according to claim 1, wherein the injection chamber (132) is provided with an annular liquid distributor, the surface of which, which is directed towards the periphery of the injection chamber (132), is provided with an outlet slot running around its circumference, so that a liquid film is obtained.

12. Device according to claim 11, wherein the liquid distributor is placed in the inner part of the injection chamber (132).

13. Device according to claim 1, wherein the injection chamber (132) is provided with an annular liquid distributor, the surface of which, which is directed towards the periphery of the injection chamber (132), is provided with a number of outlet openings, so that a liquid film is obtained.

14. Device according to claim 1, wherein the injection chamber (132), in its inner part, is provided with a number of liquid distributors (190), which have outlet openings (192) or mouthpieces directed towards the outer part of the injection chamber (132).

* * * * *